US012012755B2

(12) United States Patent
McDuff

(10) Patent No.: US 12,012,755 B2
(45) Date of Patent: Jun. 18, 2024

(54) TILE SYSTEM FOR CEILING AND WALL

(71) Applicant: GESTION MCD INC., Saint-Bruno-de-Montarville (CA)

(72) Inventor: Rodrigue McDuff, St-Bruno-de-Montarville (CA)

(73) Assignee: ARMFOAM INC., Longueuil (CA)

( * ) Notice: Subject to any disclaimer, the term of this patent is extended or adjusted under 35 U.S.C. 154(b) by 120 days.

(21) Appl. No.: 17/436,209

(22) PCT Filed: Feb. 28, 2020

(86) PCT No.: PCT/CA2020/050265

§ 371 (c)(1),
(2) Date: Sep. 3, 2021

(87) PCT Pub. No.: WO2020/176974

PCT Pub. Date: Sep. 10, 2020

(65) Prior Publication Data

US 2022/0145625 A1 May 12, 2022

Related U.S. Application Data

(60) Provisional application No. 62/814,550, filed on Mar. 6, 2019.

(51) Int. Cl.
*E04B 9/04* (2006.01)

(52) U.S. Cl.
CPC ..... *E04B 9/0435* (2013.01); *E04B 9/0464* (2013.01); *E04B 9/0485* (2013.01)

(58) Field of Classification Search
CPC ..... E04B 9/0435; E04B 9/001; E04B 9/0478; E04F 13/075; E04F 13/076; E04F 13/08; E04F 13/0867; B44C 5/0461
See application file for complete search history.

(56) References Cited

U.S. PATENT DOCUMENTS 357,144 A * 2/1887 Buttler ..... E04F 15/04 52/592.2
2,112,631 A * 3/1938 MacDonald ..... E04B 9/0478 52/145

(Continued)

FOREIGN PATENT DOCUMENTS

DE 102014010739 A1 6/2015
FR 2893646 A1 5/2007

(Continued)

OTHER PUBLICATIONS

Translation of KR10-156167 (Year: 2015).*

*Primary Examiner* — Gisele D Ford
(74) *Attorney, Agent, or Firm* — NORTON ROSE FULBRIGHT CANADA LLP

(57) ABSTRACT

A tile comprises a main body having an exposed side and a concealed side. The exposed side defines a main surface and the concealed side defines a rear plane. Side surfaces between the exposed side and the concealed side of the main body have tongue-and-groove arrangements in the rear plane. The main body is made of at least one layer of acoustic felt defining at least one of the exposed side or the concealed side. The at least one layer of acoustic felt has a main plane of at least one compressed portion, with at least one embossed portion projecting from the main plane of the at least one compressed portion.

19 Claims, 3 Drawing Sheets

(56) References Cited

U.S. PATENT DOCUMENTS

| | | | | |
|---|---|---|---|---|
| 2,851,134 | A * | 9/1958 | Robinson, Jr. | E04F 13/12 52/506.1 |
| 3,077,426 | A * | 2/1963 | Johnston | E04B 9/0464 52/794.1 |
| 7,698,859 | B2 * | 4/2010 | Sansano Marti | E04F 15/02194 52/302.1 |
| 8,316,606 | B2 * | 11/2012 | Siewert | E04F 13/10 52/592.4 |
| 8,726,603 | B2 * | 5/2014 | Huang | E04F 15/02038 52/591.1 |
| 2007/0193131 | A1 * | 8/2007 | Ortiz | E04B 9/0478 52/144 |
| 2007/0214741 | A1 * | 9/2007 | Llorens Miravet | E04F 15/02 52/592.1 |
| 2009/0178367 | A1 * | 7/2009 | Barlow | B44C 1/28 52/745.13 |
| 2015/0107177 | A1 * | 4/2015 | Khongbantabam | E04F 13/0894 52/311.2 |
| 2016/0289963 | A1 | 10/2016 | McDuff | |
| 2020/0095776 | A1 * | 3/2020 | Kim | E04F 13/18 |
| 2020/0131783 | A1 * | 4/2020 | Liu | B32B 27/18 |
| 2022/0034729 | A1 * | 2/2022 | Petersen | B32B 3/04 |

FOREIGN PATENT DOCUMENTS

| | | | |
|---|---|---|---|
| JP | 2007224704 | A | 9/2007 |
| JP | 4465802 | B2 | 3/2010 |
| KR | 10-1561674 | * | 10/2015 |

* cited by examiner

TILE SYSTEM FOR CEILING AND WALL

TECHNICAL FIELD

The present application relates to tile systems for ceilings and walls.

BACKGROUND OF THE ART

Tile systems are commonly used for applications such as covering ceilings and walls. In addition to providing esthetic or decorative functions, tile systems may also perform additional functions such as soundproofing or sound absorption. For example, in institutional size facilities, such as gymnasiums, the use of tile systems is often favored. The tiles making up ceilings and/or walls of such facilities may be subjected to impacts, such as from balls in a gymnasium. This may affect their structural integrity and/or hamper their functional capabilities, such as their sound absorption properties.

SUMMARY

It is therefore an aim of the present disclosure to provide a tile system that addresses issues related to the prior art.

Therefore, in accordance with the present disclosure, there is provided a tile comprising a main body having an exposed side and a concealed side, the exposed side defining a main surface, the concealed side defining a rear plane, and side surfaces between the exposed side and the concealed side of the main body, the side surfaces having tongue-and-groove arrangements in the rear plane, wherein the main body is made of at least one layer of acoustic felt, the at least one layer of acoustic felt defining at least one of the exposed side or the concealed side, the at least one layer of acoustic felt having a main plane of at least one compressed portion, with at least one embossed portion projecting from the main plane of the at least one compressed portion.

Further in accordance with the first aspect, for instance, the main body has four side surfaces, a first two of the four side surfaces having a first tongue-and-groove arrangement in the rear plane, and another two of the four side surfaces having a second tongue-and-groove arrangement in the rear plane, the first tongue-and-groove arrangement being complementary to the second tongue-and-groove arrangement.

Further in accordance with the first aspect, for instance, the main body and the tongue-and-groove arrangements are defined by a single piece shell made from the at least one layer of acoustic felt.

Further in accordance with the first aspect, for instance, the single piece shell has a hollow cavity opposite the main surface, the at least one embossed portion being in the hollow cavity.

Further in accordance with the first aspect, for instance, a peripheral edge of the single piece shell, excluding grooves of the tongue-and-groove arrangements, lies in the rear plane.

Further in accordance with the first aspect, for instance, opposite side surfaces respectively have the first tongue-and-groove arrangement and the second tongue-and-groove arrangement.

Further in accordance with the first aspect, for instance, the first tongue-and-groove arrangement has an alternating sequence of four tongues separated by four grooves, and wherein the second tongue-and-groove arrangement has an alternating sequence of four tongues grooves separated by four tongues offset relative to the first tongue-and-groove arrangement.

Further in accordance with the first aspect, for instance, the exposed side is flat.

Further in accordance with the first aspect, for instance, the tile further comprises a layer of decorative liner.

Further in accordance with the first aspect, for instance, the decorative liner is a fabric.

Further in accordance with the first aspect, for instance, the tile further comprises an adhesive film between the at least one layer of acoustic felt and the decorative liner.

Further in accordance with the first aspect, for instance, the at least one layer of acoustic felt has a density ranging between 250 and 1000 g/m$^3$.

Further in accordance with the first aspect, for instance, the main body has a rectangular shape.

Further in accordance with the first aspect, for instance, the at least one layer of acoustic felt is a polyethylene terephthalate felt.

Further in accordance with the first aspect, for instance, the tongue-and-groove arrangements include tongues with at least one surface boss projecting towards the exposed side.

In another aspect, there is provided a tile system comprising a plurality of interconnected tiles in accordance with the first aspect.

Further in accordance with the second aspect, for instance, the plurality of tiles are installed side-by-side in a repeated pattern.

Further in accordance with the second aspect, for instance, neighbouring tiles are arranged for complementary engagement of adjacent tongue-and-groove arrangements.

DETAILED DESCRIPTION

Figure 1:
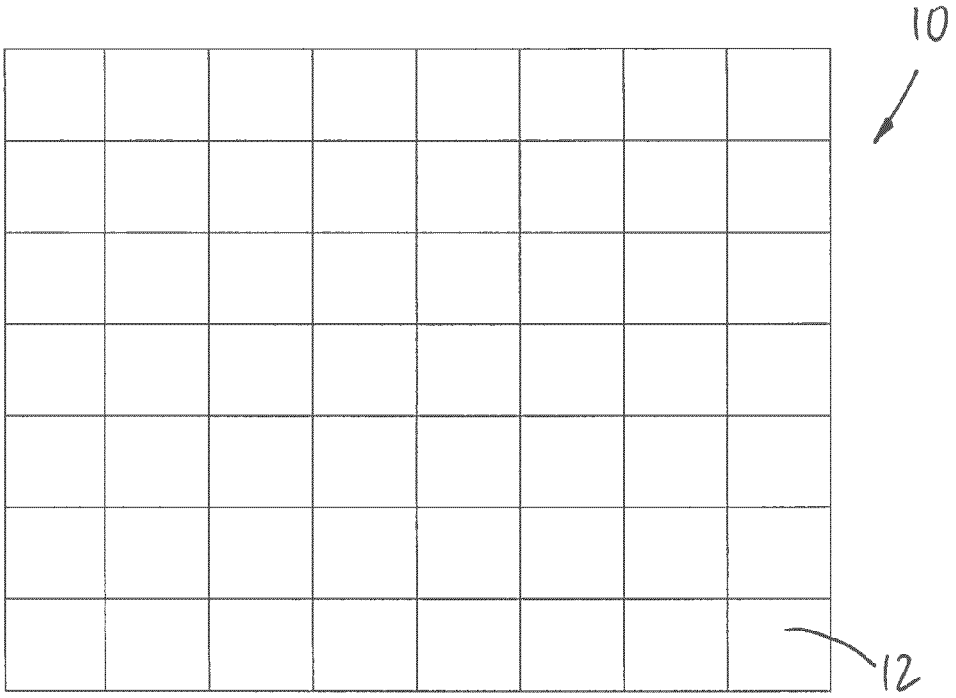
FIG. 1 is a perspective view of a tile system of the present disclosure, as secured to a surface.

Referring to the drawings and, more particularly, to FIG. 1, a tile system in accordance with the present disclosure, is shown at 10, that may be used to cover a surface, such as a grid, a suspended ceiling structure, a ceiling, a wall, etc. The tile system 10 globally has a plurality of tiles 12, for instance known as end panels. In an embodiment, a plurality of upside-down T-channels (not shown) suspended from an overhead structure such as a ceiling, form a grid to support the plurality of tiles 12. Other components may be used to secure the tiles 12 to a surface and/or to each other, such as screws, clips, adhesives and/or end mouldings. For example, U.S. Pat. No. 9,951,518, incorporated herein by reference, discloses the hardware that may be used with the tile system 10 and tiles 12. The tiles 12 may be attached directly to a surface, i.e., without a structure of T-channels of a suspended ceiling.

Figure 3:
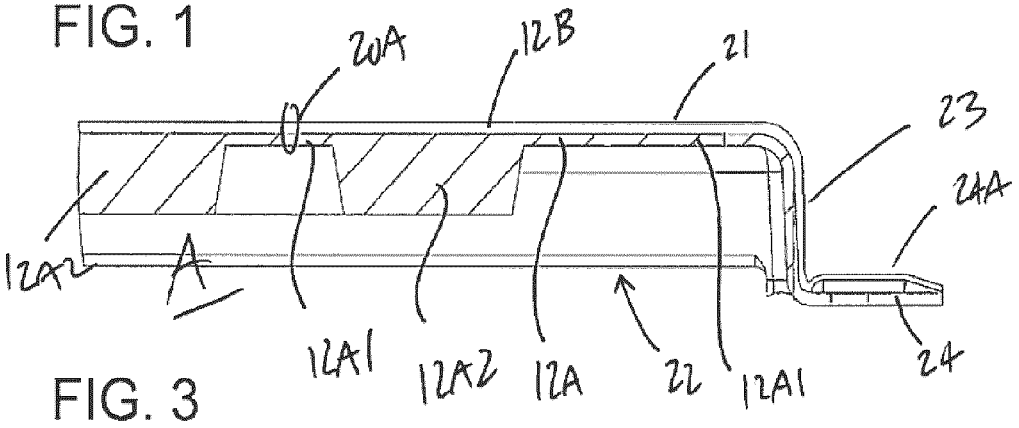
FIG. 3 is an enlarged sectional view of the tile of FIG. 2.
Figure 2:
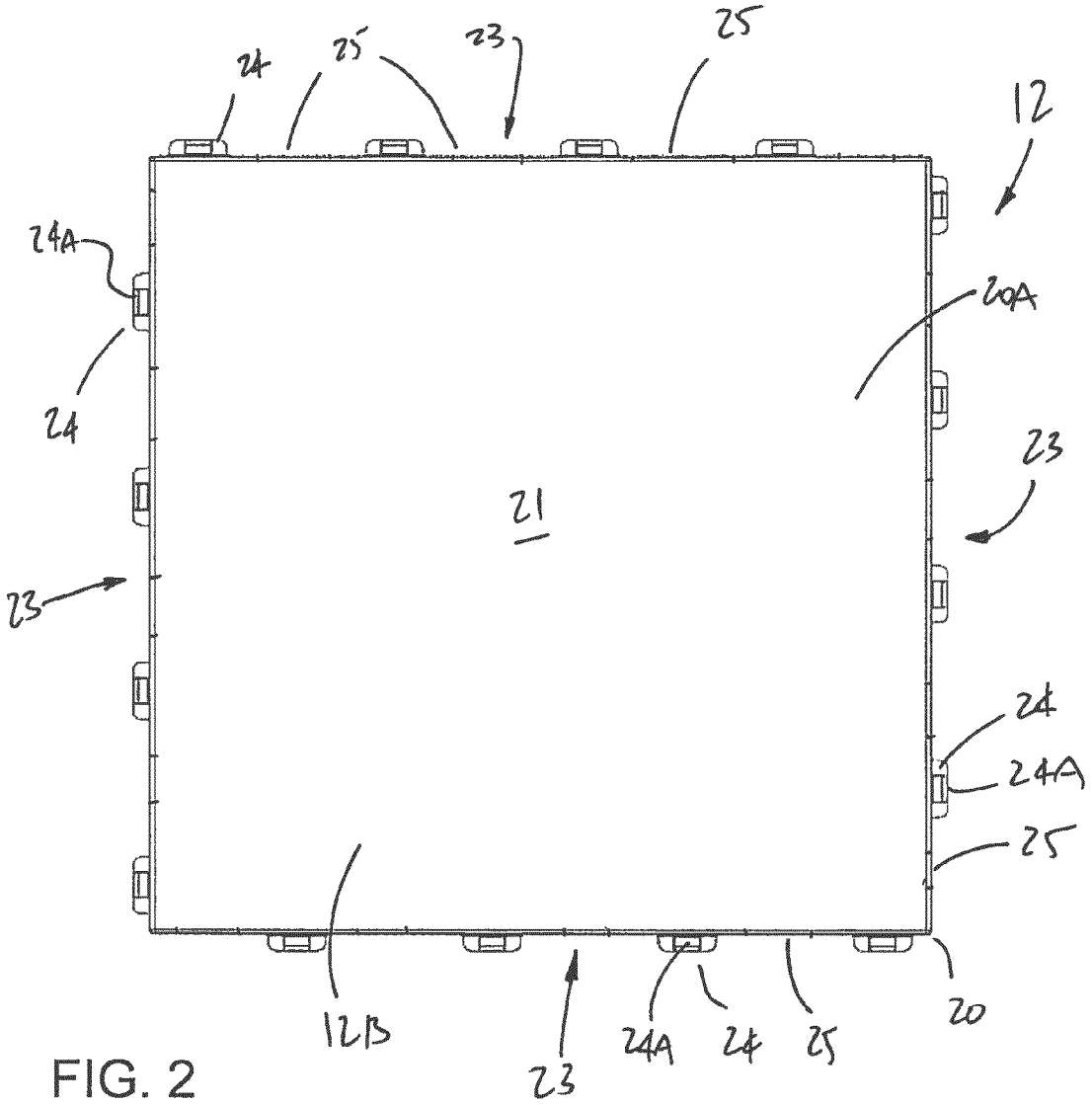
FIG. 2 is a face view of a tile of the tile system of FIG. 1.

Referring concurrently to FIGS. 2 and 3, a tile 12 is shown in greater detail. The tile 12 may be made of any appropriate material and have various properties. The tile 12 has a main body 20 that may have a rectangular shape (including a square shape as in the illustrated embodiment), which may in turn allow a grid of tiles 12 to be formed, as shown in FIG. 1. Other geometrical shapes are considered. In an embodiment, different polygonal or arcuate shapes are considered. In an embodiment, the tiles 12 are shown to be installed side by side in repeated patterns, whereby there are numerous contemplated shapes and/or arrangements, in similar fashion to floor tiles. The shapes may include rectangles, hexagons, squares, circles, or any combinations thereof. In an embodiment, all tiles 12 are of the same shape, but there may be different shapes for different sets of tiles 12. For example, some tiles may be rectangular, with the squares have a side dimension C×C, and the rectangles being 2C×C, for example. For simplicity, only the square version is shown herein.

The tile 12 may be an acoustic tile made by one or more layers that are molded and/or thermoformed into the shape shown in FIGS. 2 and 3. In an embodiment, the tile 12 has one or more layers, with one of which being a layer of acoustic felt 12A or a like porous material that has sound absorbing properties due to its porous nature. This may include some woven textile layers in some embodiments. In an embodiment, the acoustic felt is a polyethylene terephthalate (PET) felt, though other materials may be used. In an embodiment, the acoustic felt 12A has a density ranging between 250 and 1000 g/m$^3$, inclusively. This is merely provided as an example, as acoustic felts 12A with other densities may be considered.

The tile 12 may also optionally have a decorative liner 12B covering the layer of acoustic felt 12A. In an embodiment, the decorative liner 12B is the exposed material when the tile 12 is installed, and hence forms the visible part of the tile 12. Other layers may be present, though not shown or not visible. For example, an adhesive film may be sandwiched between the layer of acoustic felt 12A and the decorative liner 12B. The decorative liner 12B may be a fabric, such as a woven textile, a felt, a metallic foil, among other possibilities.

As shown in FIG. 3, the acoustic felt 12A may have a variation in density, with compressed portions 12A1, and embossed portions 12A2. In an embodiment, the acoustic felt 12A has the same composition throughout the tile 12, with the alternation between compressed portions 12A1 and embossed portions 12A2 being a change in density, the compressed portions 12A1 having a greater density than the embossed portion 12A2. Accordingly, the embossed portions 12A2 preserve at least some of the original porosity of the acoustic felt 12A. In contrast, the compressed portions 12A1 lose the original porosity of the acoustic felt 12A, but gain in structural rigidity. The compressed portions 12A1 therefore provide structural rigidity that will be used to allow the assembly of tiles 12 in the manners described below. Such a tile 12 may result from a lamination process, in which the various layers are pressed in a mold having embossment cutouts to enable the embossed portions 12A2. The mold may be in the form of a pair of flat plates with cutouts to define the embossed portions 12A2, the flat plates being heated and pressed against one another. The embossed portions 12A2 may therefore be uncompressed parts of the layer in the lamination process. In such an embodiment, a single material layer acoustic felt 12A may undergo the lamination process to create both the compressed portions 12A1 and the embossed portions 12A2 of the tile 12, both portions having the same composition yet different densities. In an embodiment, the embossed portions 12A2 face outwardly and are exposed. However, in FIGS. 2 and 3, the embossed portions 12A2 face inwardly and are concealed, as explained below. Hence, in such an embodiment the embossed portions 12A2 are protected from impacts. In the embodiment shown in FIG. 4, even though the embossed portions 12A2 are concealed, the variation in density may be apparent at the exposed side. Hence, the embossed portions 12A2 may be visible in spite of not projecting outwardly from the decorative liner 12B as shown in FIG. 3. In an embodiment, a main plane of the surface of the acoustic felt 12A is defined by the compressed portion(s) 12A1, with the embossed portion(s) 12A2 projecting from the main plane of the compressed portion(s) 12A1.

In an embodiment, the tile 12 may be molded in a single material, or be laminated from different materials, etc. For example, the tile 12 may consists of a single monolithic polymeric material, or may be an assembly of different materials. The decorative liner 12B may even be made in a metallic material, etc.

The main body 20 has a main wall 20A that defines an exposed surface 21 (a.k.a., side) of the main body 20. The exposed surface 21, made of the decorative liner 12B in the illustrated embodiment, faces away from the covered surface when the tile system 10 is installed. For example, when the tile system 10 is installed in a ceiling, the exposed surface or side 21 may face downwardly. In another embodiment, the tile system 10 may be installed on a side wall, and as such the exposed surface or side 21 would face outwardly from the wall. The exposed surface 21 may have geometrical shapes and 3D patterns defined therein, for decorative purposes among other reasons, though it is shown in FIG. 3 as being substantially flat or smooth. A concealed side 22 is on the other side of the main body 20, and is conventionally arranged to face toward the surface or structure (e.g., such as a grid, wall, ceiling), the concealed side 22 exposing the acoustic felt 12A. A rear most plane of the concealed side 22, at its periphery, may contact the covered surface (e.g., wall, ceiling, grid structure). Side surfaces 23 are on the perimeter of the main wall 20A. The side surfaces 23 generally span the thickness of the main body 20. The side surfaces are concurrently referred to as 23. The combination of the main wall 20A and side surfaces 23 define an inner cavity A. The inner cavity A may be empty or hollow, or may incorporate a filler material, such as one having insulating and/or sound absorbing capacity. In FIG. 3, other than the main wall 20A, the tile 12 is shown having an empty inner cavity A, with the embossed portions 12A2 delimiting the inner cavity A. It is observed that the side surfaces 23 shown in FIG. 3 do not have embossed portions 12A2, as the shown side surfaces 23 are constituted only of the compressed portions 12A1. In such an embodiment, the side surfaces 23 benefit from the structural rigidity provided by the compressed portions 12A1 as they play a structural role in the assembly of tiles 12 in a side by side manner.

The side surfaces 23 are provided with tongue-and-groove arrangements in the rear plane defined by the concealed side 22, for complementary engagement of tiles 12 when positioned side by side, with complementary tongue-and-groove arrangements facing each other. Tongues 24 project laterally from the side surfaces 23, whereas grooves 25 are defined into the side surfaces 23. In an embodiment, the tongues 24 are projections from the material of the body 20, the body 20 being in such an embodiment a single piece shell. This is a possibility among others, with other embodiments featuring the addition of strips to form the tongues 24, or tongues 24 being comolded with the main body 20. In an embodiment, the tongues 24 are generally coplanar with a peripheral edge of the concealed side 22, while the grooves 25 open to the concealed side 22. The tongues 24 may optionally have surface bosses 24A, projecting in the exposed direction (as shown in FIG. 3). It is also considered that a peripheral edge of the single piece shell of the main body 20, excluding grooves 25 of the tongue-and-groove arrangements, lies in the rear plane. When the tongues 24 are integral with it, the body 20 may have a sufficient structural integrity and rigidity for the tongues 24 to support the weight of the whole tile 12 in suspension. In other words, the tile 12 may be hung by its tongues 24, whereby it is necessary that the tongues 24 be capable of sustaining the weight of the tile 12. It is also considered to have a single tongue 24 on a given side surface 23. Such a single tongue 24 may be elongated to cover a substantial portion of the length of the given side surface 23.

The grooves 25 may be formed, laminated, machined, or molded into the main body 20, or may result from the simple deformation of the material of the main body 20 when tongues 24 are fitted there. In an embodiment, when assembling two or more tiles, the grooves 25 on a first side surface 23 of a first tile 12 are used to receive the tongues 24 of a corresponding side surface 23 of an adjacent second tile 12. In an embodiment, the tongues 24 are thin, and as such the groove 25 need not be deep. The presence of the surface bosses 24A may serve as mechanical interference once adjacent tiles 12 are assembled.

In a tile 12, as best seen in FIG. 2, adjacent tongues 24 are spaced apart by one of the grooves 25, and a sequence of alternating tongues 24 and grooves 25 is circumferentially distributed about the main body 20. As observed from the embodiment shown in FIG. 2, opposite side surfaces 23 of a same tile 12 are not mirror images of one another, as adjacent tiles 12 must have complementary tongue and groove patterns so that they may be interconnected. As exemplified by FIG. 2, the tile 12 has four tongues 24 and four grooves 25 on each of the side surfaces 23. This is one possible pattern among others, as more or less tongues and grooves may be considered. In such a way, all tiles 12 may be the same, and have a unique tongue and groove pattern. It is however also contemplated to have two sets of tiles 12, with each side of a first type of tile 12 being complementary to the sides of a second type of tile 12. Another embodiment may include two side surfaces 23 of a first type, for two side surfaces 23 of a second type, with the side surfaces 23 of the first type being configured for complementary engagement with the side surfaces 23 of the second type. As another possibility, a single tile 12 may have four different side surfaces 23, provided complementary engagement is possible with adjacent tiles 12. It is also considered to have a single elongated tongue 24 and no groove 25 on a side surface 23, and a complementary single elongated groove 25 and no groove 24 on another side surface 23.

Therefore, the tile 12 has the main body 20 with its exposed side 21 and concealed side 22, the exposed side 21 defining a main surface of the main wall 20A. The concealed side 22 defines a rear plane. The side surfaces 23 are between the exposed side 21 and the concealed side 22 of the main body 20. The side surfaces 23 may have a tongue-and-groove arrangement in the rear plane. The main body 20 is made of the layer of acoustic felt 12A and may be of other layers. The acoustic felt 12A may define the exposed side 21 and/or the concealed side 22. The acoustic felt 12 has a main plane of compressed portion(s) 12A1, with embossed portion(s) 12A2 projecting from the main plane of the compressed portion(s) 12A1.

Figure 4:
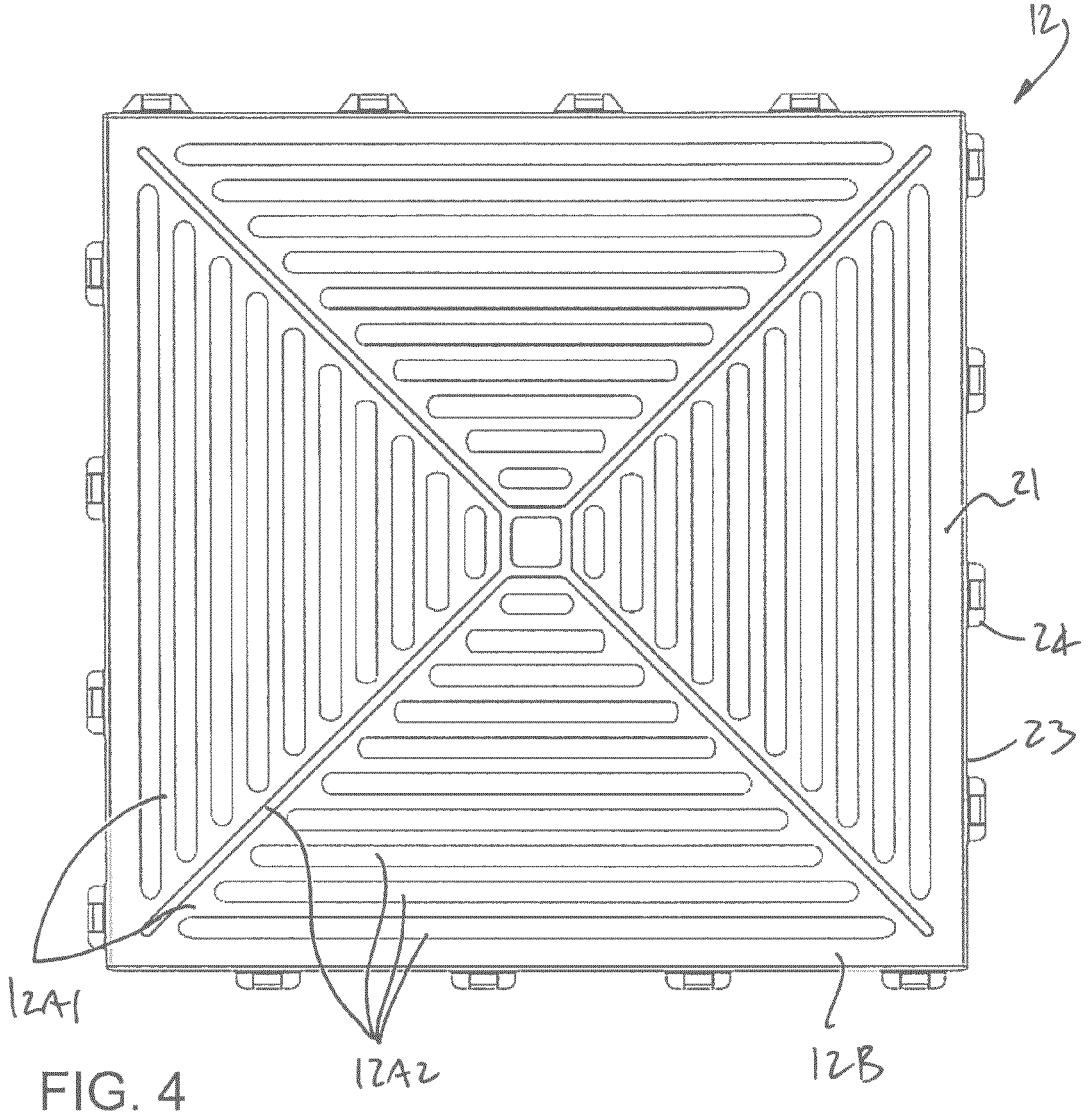
FIG. 4 is a face view of a tile of the tile system of FIG. 1, showing a possible pattern of embossed portions.

In an embodiment, the embossed portions 12A2 represent between 30 and 60% of the side 21 and/or 22, a remainder being constituted of the compressed portions 12A1. FIG. 4 shows a particular pattern with a plurality of elongated embossed portions 12A2. This arrangement is representative of a web of compressed portion(s) 12A1, ensuring a presence of both the compressed portions 12A1 and the embossed portions 12A2 throughout the main wall 20A. Other arrangements are considered. For example, dots, squares or like discrete shapes (e.g., stars) of the embossed portions 12A2 could be present in addition to or as alternatives to the elongated embossed portions 12A2.

In order to assemble the tiles 12 into a tile system 10 as in FIG. 1, a method of installation as described in U.S. Pat. No. 9,951,518 may be used. As an alternative to clips, screws, nails and/or staples may be used to secure the tongues 24 of the tiles 12 against the surfaces covered by the tile system 10.

The embodiments described in this document provide non-limiting examples of possible implementations of the present technology. Upon review of the present disclosure, it can be recognized that changes may be made to the embodiments described herein without departing from the scope of the present technology.

The invention claimed is:

1. A tile comprising a main body having an exposed side and a concealed side, the exposed side defining a main surface, the concealed side defining a rear plane, and side surfaces between the exposed side and the concealed side of the main body, the side surfaces having tongue-and-groove arrangements in the rear plane, wherein the main body is made of at least one layer of acoustic felt, the at least one layer of acoustic felt defining at least one of the exposed side or the concealed side, the at least one layer of acoustic felt having a main plane of at least one compressed portion, with at least one embossed portion projecting from the main plane of the at least one compressed portion.

2. The tile according to claim 1, wherein the main body has four of the side surfaces, a first two of the side surfaces having a first tongue-and-groove arrangement in the rear plane, and another two of the side surfaces having a second tongue-and-groove arrangement in the rear plane, the first tongue-and-groove arrangement being complementary to the second tongue-and-groove arrangement.

3. The tile according to claim 1, wherein the main body and the tongue-and-groove arrangements are defined by a single piece shell made from the at least one layer of acoustic felt.

4. The tile according to claim 3, wherein the single piece shell has a hollow cavity opposite the main surface, the at least one embossed portion being in the hollow cavity.

5. The tile according to claim 3, wherein a peripheral edge of the single piece shell, excluding grooves of the tongue-and-groove arrangements, lies in the rear plane.

6. The tile according to claim 2, wherein opposite side surfaces respectively have the first tongue-and-groove arrangement and the second tongue-and-groove arrangement.

7. The tile according to claim 2, wherein the first tongue-and-groove arrangement has an alternating sequence of four tongues and four grooves, and wherein the second tongue-and-groove arrangement has an alternating sequence of four tongues grooves separated by four tongues offset relative to the first tongue-and-groove arrangement.

8. The tile according to claim 1, wherein the exposed side is flat.

9. The tile according to claim 1, further comprising a layer of decorative liner.

10. The tile according to claim 9, wherein the decorative liner is a fabric.

11. The tile according to claim 9, further comprising an adhesive film between the at least one layer of acoustic felt and the decorative liner.

12. The tile according to claim 1, wherein the at least one layer of acoustic felt has a density ranging between 250 and 1000 $g/m^3$.

13. The tile according to claim 1, wherein the main body has a rectangular shape.

14. The tile according to claim 1, wherein the at least one layer of acoustic felt is a polyethylene terephthalate felt.

15. The tile according to claim 1, wherein the tongue-and-groove arrangements include tongues with at least one surface boss projecting towards the exposed side.

16. A tile system comprising a plurality of interconnected tiles according to claim 1.

17. The tile system according to claim 16, wherein the plurality of tiles are installed side-by-side in a repeated pattern.

18. The tile system according to claim 16, wherein neighbouring tiles are arranged for complementary engagement of adjacent tongue-and-groove arrangements.

19. A tile comprising a main body having an exposed side and a concealed side, the exposed side defining a main surface, the concealed side defining a rear plane, and side surfaces between the exposed side and the concealed side of the main body, the side surfaces having tongue-and-groove arrangements in the rear plane, wherein the main body is made of at least one layer of acoustic felt, the at least one layer of acoustic felt defining at least one of the exposed side or the concealed side, the at least one layer of acoustic felt having on its exposed side at least one compressed portion, with at least one embossed portion projecting outwardly in the exposed side relative the at least one compressed portion, the at least one embossed portion having a greater thickness than the at least one embossed portion.

* * * * *